US007453327B2

(12) United States Patent
Fluhrer

(10) Patent No.: US 7,453,327 B2
(45) Date of Patent: Nov. 18, 2008

(54) SYMMETRIZING ARRANGEMENT

(75) Inventor: Christoph Fluhrer, Neuried (DE)

(73) Assignee: Rodhe & Schwarz GmbH & Co., KG, Munich (DE)

( * ) Notice: Subject to any disclaimer, the term of this patent is extended or adjusted under 35 U.S.C. 154(b) by 191 days.

(21) Appl. No.: 10/556,279

(22) PCT Filed: Mar. 22, 2004

(86) PCT No.: PCT/EP2004/003021

§ 371 (c)(1),
(2), (4) Date: Dec. 6, 2006

(87) PCT Pub. No.: WO2004/102729

PCT Pub. Date: Nov. 25, 2004

(65) Prior Publication Data

US 2007/0090893 A1 Apr. 26, 2007

(30) Foreign Application Priority Data

May 14, 2003 (DE) ..... 103 21 684
Jun. 24, 2003 (DE) ..... 103 28 333

(51) Int. Cl.
*H01P 5/10* (2006.01)
*H01P 5/12* (2006.01)

(52) U.S. Cl. ..... 333/26; 333/25

(58) Field of Classification Search ..... 333/25, 333/26

See application file for complete search history.

(56) References Cited

U.S. PATENT DOCUMENTS 4,857,869 A 8/1989 Terakawa et al. ..... 333/26

(Continued)

FOREIGN PATENT DOCUMENTS

EP 0 426 988 A1 10/1990

(Continued)

OTHER PUBLICATIONS

Riddle, Alfy, "Ferrite and Wire Baluns with Under 1dB Loss to 2.5 Ghz," 1998 IEEE MTT-S Digest.

(Continued)

*Primary Examiner*—Dean O Takaoka
(74) *Attorney, Agent, or Firm*—Lewis, Rice & Fingersh, L.C.

(57) ABSTRACT

A re-balancing device (1) comprising a line (12). Said line comprises a first pole (3) of a first conductor (2) and a first pole (6) a second conductor (5) on a first side (8), in addition to a second pole (7) of a first conductor (2) and a second pole (7) of a second conductor (5) on a second side. The second side (9) of the line (12) is connected to a network consisting of impedances and a symmetrical connection (Out), with a first end (10) and a second end (11). The first pole (3) of the first conductor (2) is directly guided to a reference potential (GR) and the two first poles (3,6) form an unsymmetrical connection (In). The second pole (4) of the first conductor (2) is connected to the first end (10) of the symmetrical connection (Out) and connected to the reference potential (GR) via the third impedance (x3). The second pole (7) of the second conductor (5) is connected, by means of the first impedance (x1) to the second end (11) of the symmetrical connection (Out) and to a pole of the second impedance (x2). The second impedance (x2) is connected to the reference potential (GR). All impedances (x1,x2,x3) are electromagnetically decoupled from each other.

14 Claims, 4 Drawing Sheets

U.S. PATENT DOCUMENTS 5,640,699 A 6/1997 Ralph ..... 455/326
6,441,696 B1 8/2002 Westberg ..... 333/26

FOREIGN PATENT DOCUMENTS

EP 0 644 605 A1 8/1994
WO WO 02/23719 A1 3/2002

OTHER PUBLICATIONS

Ang, K.; Leong, Y., and Lee, C., "Analysis and Design of Miniaturaized Lumped-Distributed Impedance-Transforming Baluns," IEEE Transactions on Microwave Theory and Techniques, vol. 51, No. 3, Mar. 2003.
Cripps, S., "RF Power Amplifiers for Wireless Communication,"pp. 283-297.

SYMMETRIZING ARRANGEMENT

Cross Reference to Related Applications

This application claims priority to German Patent Application DE10321684.7filed May 14. 2003and German Patent Application DE10328333.1filed Jun.24. 2003. The entire disclosure of both these documents is herein incorporated by reference.

The invention relates to a re-balancing arrangement as used, for example, in the transition from a circuit symmetrical to earth to an asymmetrical circuit or line. A circuit of this kind, which is generally referred to in the literature as a balun (balanced to un-balanced or balancing unit) is used to supply a symmetrical load, for example, with an asymmetrical line or to connect to a circuit and vice versa. Baluns are often found at the connection for antennae, for example, when connecting a dipole antenna to a coaxial cable or at the transition from a single-ended amplifier to a push-pull amplifier.

In essence, baluns of this kind prevent circulating currents, which occur when asymmetrically operated circuits are connected to circuits operated symmetrically, because, in symmetrical operation, which is also referred to as push-pull operation, current and voltage, for example, on a double line in a conductor, are of identical magnitude and in phase opposition relative to the nearest respective part of the other conductor. By contrast, in common mode, current and voltage on both conductors are in phase. These circulating currents also occur in the context of matched surge impedances, wherein baluns can also be used at the same time for impedance transformation and therefore for the matching of surge impedances.

The basic method of operation of a balun is such that the in-phase component from common-mode operation is cancelled by a transfer of phase rotation of 180° to the component in phase opposition.

Circuit arrangements of this kind are known from the literature. For example, so-called lambda/4-line balun consisting of a coaxial cable is described on page 290 of "RF Power Amplifiers for Wireless Communications" by Steve C. Cripps, 1999, Artech House Inc., ISBN 0-89006-989-1. In this context, the length of the coaxial cable must correspond to one quarter of the wavelength to be transmitted.

Baluns, which are built up solely with lumped elements, namely inductances and capacitances or transformers, are also known from the above literature on page 292.

EP 0 644 605 A1 discloses a compensating circuit for a re-balancing arrangement, which consists of three electromagnetically-coupled inductances and an amplitude and phase compensating circuit.

EP 0 426 988 A1 discloses a balancing loop with a line and capacitances at the output.

The disadvantage with the re-balancing arrangement of the prior art is that the use of line lengths corresponding to approximately one quarter of the wavelength to be transmitted makes the structural size of the balun inexpediently large for many areas of application, and the baluns are therefore often unusable, especially with stripline technology. Furthermore, harmonic frequency ranges are not suppressed and the impedance-transformation ratio, which is 2:1 in lambda/4-line baluns, cannot be modified.

In the case of re-balancing arrangements with lumped elements and inductances or capacitances, the bandwidth is also severely restricted; this cannot be substantially improved with a simple compensating circuit.

The object of the invention is therefore to provide a simply-structured re-balancing arrangement, which can have a significantly smaller structural size while retaining a wide bandwidth, wherein harmonic frequency ranges are suppressed and the impedance-transformation ratio is variable.

The object is achieved according to the invention by a re-balancing arrangement with the characterising features of claim 1 in combination with the generic features.

According to the invention, a network consisting of at least three impedances is series connected to an essentially homogeneously-structured line earthed at a single-pole with at least two conductors and an asymmetrical connection.

Advantageous further developments are specified in the dependent claims.

Exemplary embodiments of the invention are described below with reference to the drawings. In the drawings, identical components are shown with the same reference numbers. The drawings are as follows.

Figure 1:
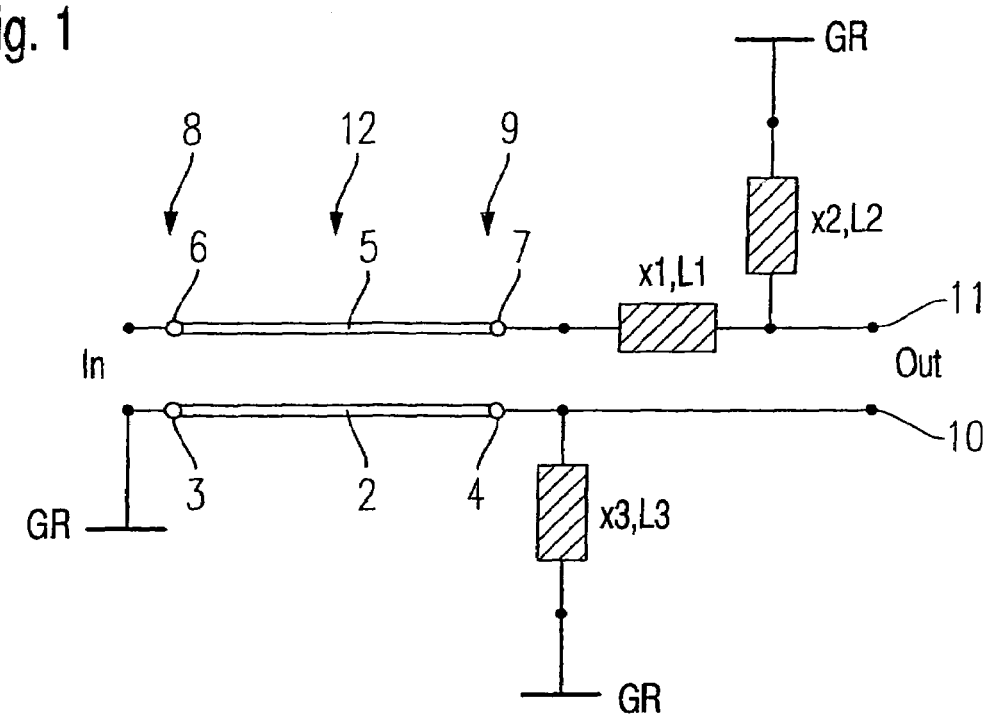
FIG. 1 shows a first exemplary embodiment of a re-balancing arrangement according to the invention.

FIG. 1 shows a first exemplary embodiment of the re-balancing arrangement according to the invention, which essentially comprises one homogeneous line 12 with a first conductor 2 and a second conductor 5 and three impedances x1, x2, x3 of the same type formed as inductances L1, L2, L3, which form a network. The line 12 has a first side 8 and a second side 9. The first side 8 comprises the first pole 3 of the first conductor 2 and the first pole 6 of the second conductor 5. The second side 9 comprises the second pole 4 of the first conductor 2 and the second pole 7 of the second conductor 5. Together with the first pole 3 of the first conductor 2, which is connected directly to a reference potential GR, the first pole 6 of the second conductor 5 forms an asymmetrical connection In.

The second side 9 of the homogeneous line 12 is connected to the network consisting of three impedances x1, x2, x3, in the exemplary embodiment, that is to say the inductances L1, L2, L3, and to a symmetrical connection Out. In this context, the second pole 4 of the first conductor 2 is directly connected to a first end 10 of the symmetrical connection Out and via the third impedance x3 and/or the third inductance L3 respectively to the reference potential GR. The second pole 7 of the second conductor 5 is connected to the second end 11 of the symmetrical connection Out via the first impedance x1 or respectively L1 and to the reference potential GR via the series connection of x1, L1 and x2, L2.

In this exemplary embodiment, the network manufactured, for example, using stripline technology, is partially responsible for the phase displacement required for re-balancing, and the second impedance x2 and the third impedance x3 have identical impedances for balancing the symmetrical connections OUT 10 and 11 relative to the reference potential GR. Their impedances in this context are significantly smaller than the impedances resulting from the arrangement of the second end 11 and of the second pole 4 relative to GR and accordingly determine these impedances. Moreover, the length of the line 12 is significantly shorter than one quarter, for example, approximately one thirteenth, of the wavelength of the frequency to be transmitted or respectively of the mean frequency of the frequency band to be transmitted. The line 12 in this exemplary embodiment provides a surge impedance on the first side 8 of, for example, 50ohms. The line 12 is still sufficiently long to allow the poles 4 and 7 to accept a different potential from that of the poles 3 and 6 relative to the reference potential GR.

Figure 2:
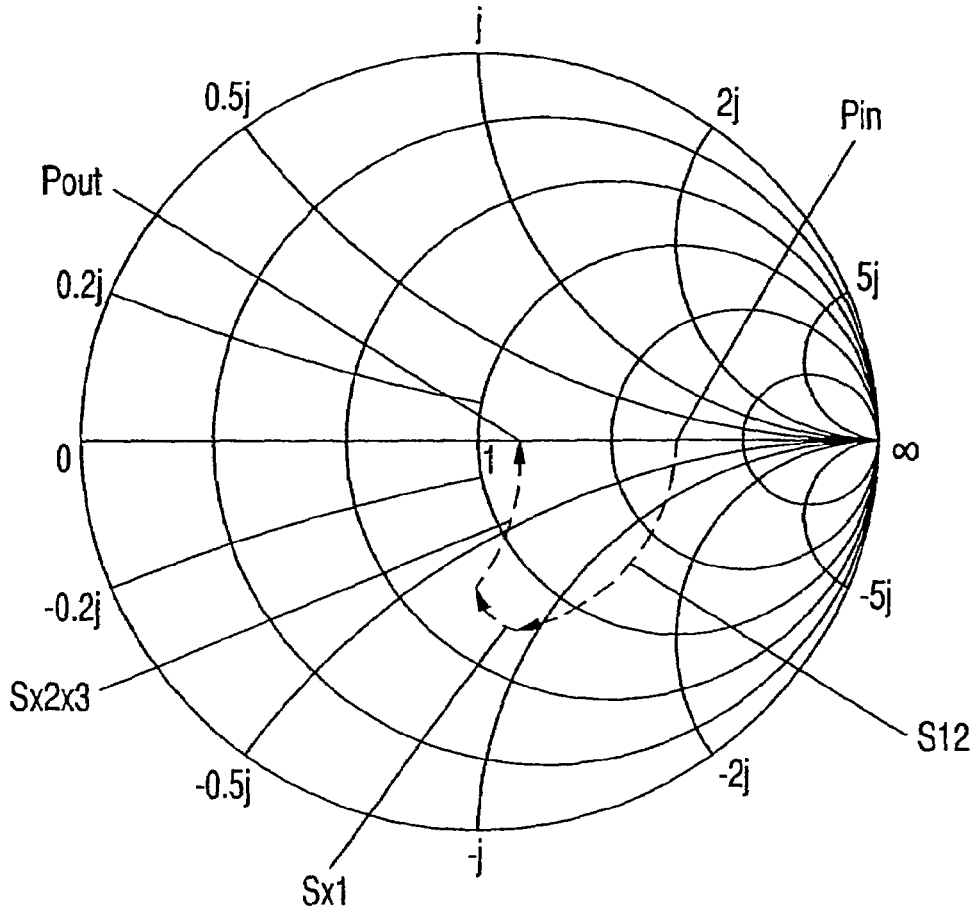
FIG. 2 shows a presentation of the impedance-transformation of the first exemplary embodiment according to the invention with reference to a Smith diagram.

FIG. 2 shows a schematic presentation of the impedance-transformation of the first exemplary embodiment according to the invention in the form of a Smith diagram. The method of presentation of a Smith diagram is not explained in greater detail here because it is a resource well-known to a person skilled in the art and widely used for the presentation of impedances and admittances at a given frequency.

The diagram shown is scaled to the line impedance of the line 12, for example, 25ohms. The point Pin indicates the surge impedance at the asymmetrical connection In. With a scaling of the diagram to 25ohms and a surge impedance of 50ohms occurring at the asymmetrical connection In, the point Pin is disposed on the real axis, running horizontally in the diagram, at a numerical value of 2, which is not illustrated here, that is to say, to the right of the numerical value 1illustrated, which, once again, corresponds to a surge impedance of 25ohms. The line segment S12, which reflects the transformation of the surge impedance along the homogeneous line 12, behaves in a capacitive manner, because the length of the line 12, at approximately one thirteenth of the wavelength of the relevant frequency, is shorter than one quarter of the relevant wavelength. The surge impedance transformed through the line segment S12 in this exemplary embodiment occurs between the poles 4 and 7.

The surge impedance as presented is further transformed as a result of the inductance L1, which, in the illustrated characteristic, is presented with reference to the distance Sx1 as an idealised series inductance acting purely as reactance. After the series-connected inductance L1, the two inductances L2 and L3, connected in series via the reference potential GR and disposed in parallel to the surge impedance, transform the surge impedance over the line segment Sx2x3 as shown to the point Pout, which is disposed, in the exemplary embodiment illustrated, on the real axis and reflects the surge impedance at the connection Out.

Depending on requirements, the line 12 and the impedances x1, x2, x3 can also be dimensioned in such a manner that a reactance component occurs at the connection Out. In the illustrated exemplary embodiment, the point Pout is disposed at approximately 30ohms. This corresponds to the surge impedance occurring between the first and second end of the connection Out or to a surge impedance of 15ohms occurring between one respective end 10, 11 of the connection Out and the reference potential GR.

With appropriate dimensioning of the structural elements, especially the lumped elements x1, x2 and x3, it is possible in a simple manner to adapt the length of the line 12, for example, to spatial conditions and at the same time to adapt the impedance-transformation ratio within broad limits to the electrical requirements.

Furthermore, depending on the requirements, an inductive or capacitive component can be adjusted.

Figure 3:
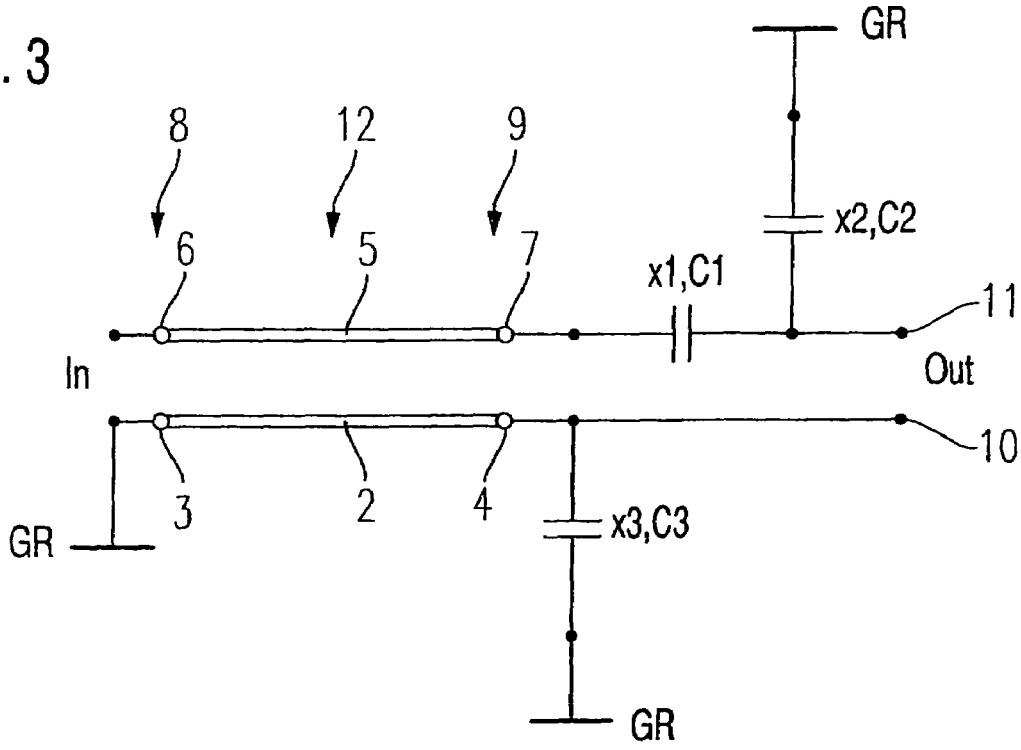
FIG. 3 shows a second exemplary embodiment of a re-balancing arrangement according to the invention.

FIG. 3 shows a second exemplary embodiment of a re-balancing arrangement according to the invention similar to the first exemplary embodiment shown in FIG. 1, but the impedances x1, x2, x3 are formed by capacitances or respectively capacitors C1, C2, C3.

Figure 4:
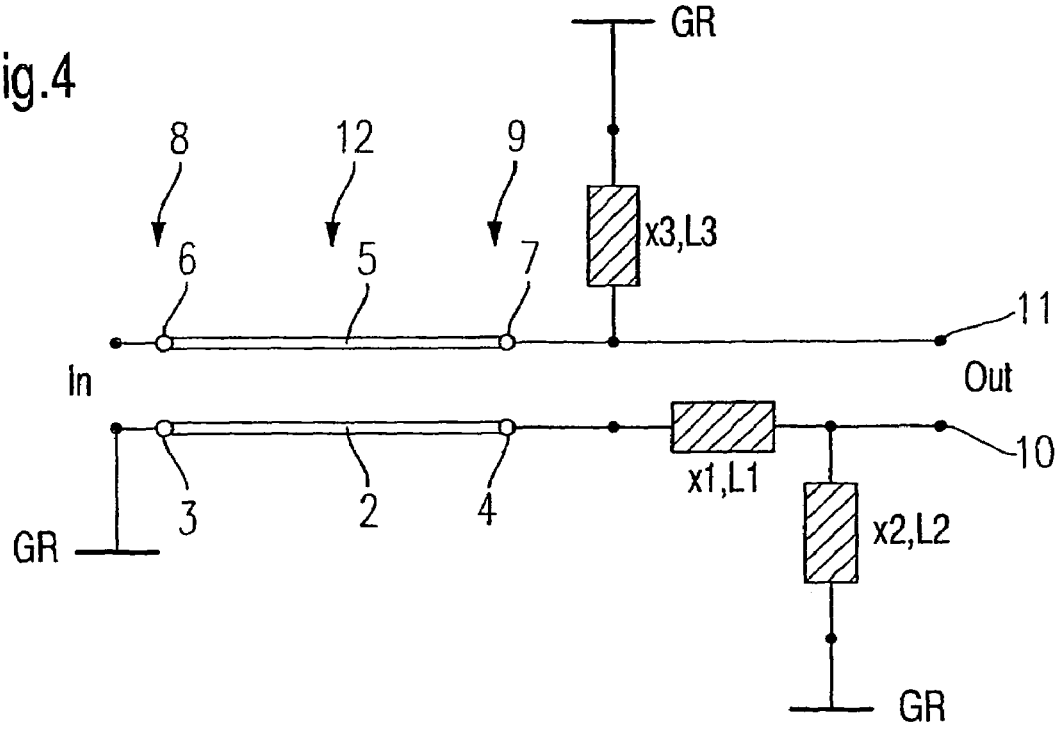
FIG. 4 shows a third exemplary embodiment of a re-balancing arrangement according to the invention.

FIG. 4 shows a third exemplary embodiment of a re-balancing arrangement according to the invention similar to the first exemplary embodiment from FIG. 1. As in FIG. 1, the second side 9 of the homogeneous line 12 is connected to the network consisting of three impedances x1, x2, x3 of the same kind in the form of inductances L1, L2, L3 and to a symmetrical connection Out. However, in this context, the second pole 4 of the first conductor 2 is connected to the first end 10 of the symmetrical connection Out via the first inductance L1 and to the reference potential GR via the series connection of x1, L1 and x2, L2. The second pole 7 of the second conductor 5 is connected directly to the second end 11 of the symmetrical connection Out and via the third inductance L3 to the reference potential GR.

Figure 5:
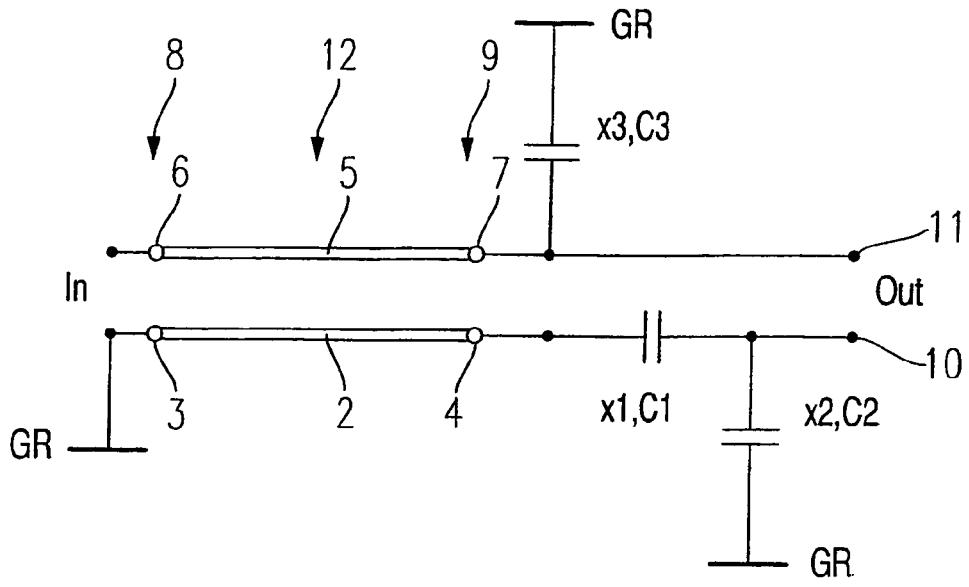
FIG. 5 shows a fourth exemplary embodiment of a re-balancing arrangement according to the invention.

FIG. 5 shows a fourth exemplary embodiment of a re-balancing arrangement according to the invention, similar to the third exemplary embodiment shown in FIG. 4, but the impedances x1, x2, x3 are formed by capacitances or respectively capacitors C1, C2, C3.

Figure 6:
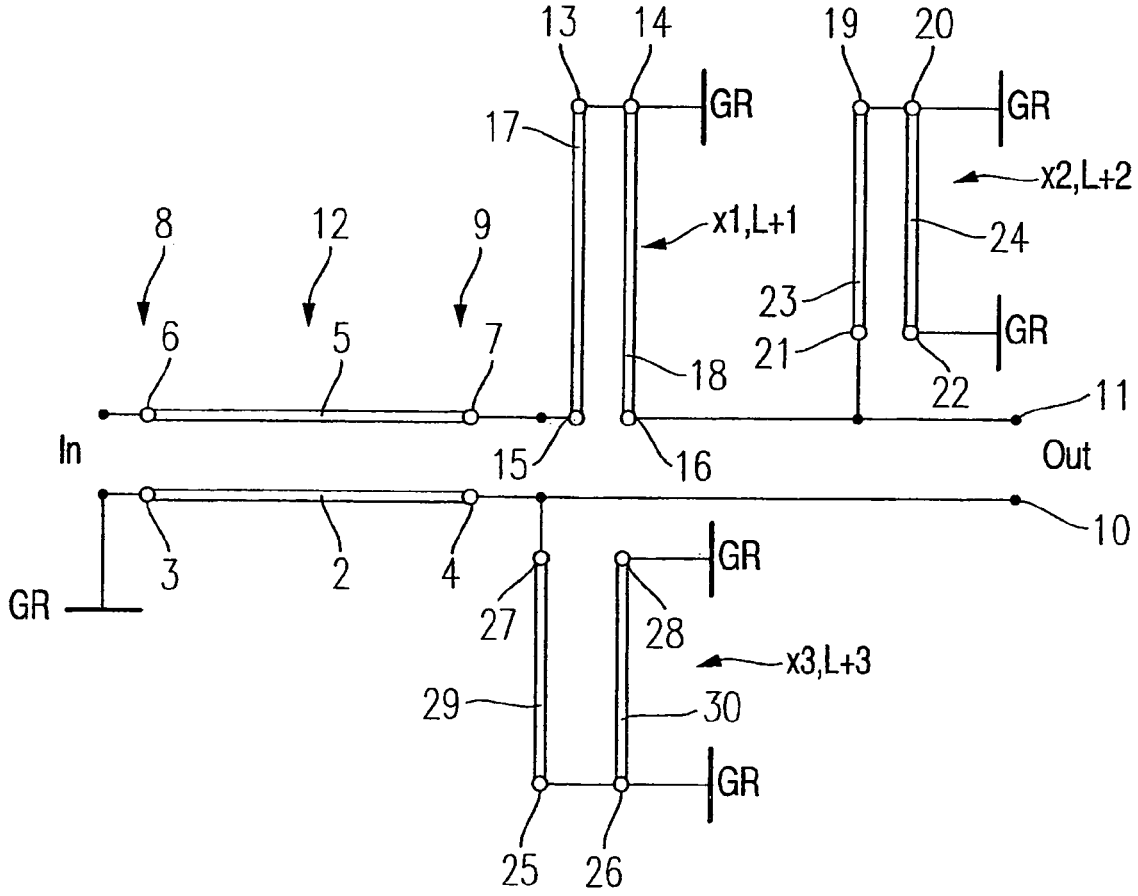
FIG. 6 shows a fifth exemplary embodiment of a re-balancing arrangement according to the invention.

FIG. 6 shows a fifth exemplary embodiment of a re-balancing arrangement 1 according to the invention, wherein the impedances x1, x2, x3 are each formed by short-circuited line portions (Lt1, Lt2, Lt3), which are manufactured in this exemplary embodiment using microstripline technology.

The first line portion Lt1 comprises a first conductor 17 with a first pole 13 and a second pole 15 and a second conductor 18 with a first pole 14 and a second pole 16. The respective first poles 13, 14 are short-circuited to each other and taken to the reference potential GR. The second pole 15 of the first conductor 17 is connected to the pole 7. The second pole 16 of the second conductor 18 is taken to the second end 11 of the symmetrical connection Out.

The second line portion Lt2 comprises a first conductor 23 with a first pole 19 and a second pole 21 and a second conductor 24 with a first pole 20 and a second pole 22. The respective first poles 19, 20 are short-circuited to each other and taken to the reference potential GR. The second pole 21 of the first conductor 23 is taken to the second end 11 of the symmetrical connection Out. The second pole 22 of the second conductor 24 is connected to the reference potential GR.

The third line portion Lt3 comprises a first conductor 29 with a first pole 25 and a second pole 27 and a second conductor 30 with a first pole 26 and a second pole 28.

The respective first poles 25, 26 are short-circuited to each other and taken to the reference potential GR. The second pole 27 of the first conductor 29 is taken to the second end 10 of the symmetrical connection Out or respectively to the pole 4. The second pole 28 of the second conductor 30 is connected to the reference potential GR.

Figure 7:
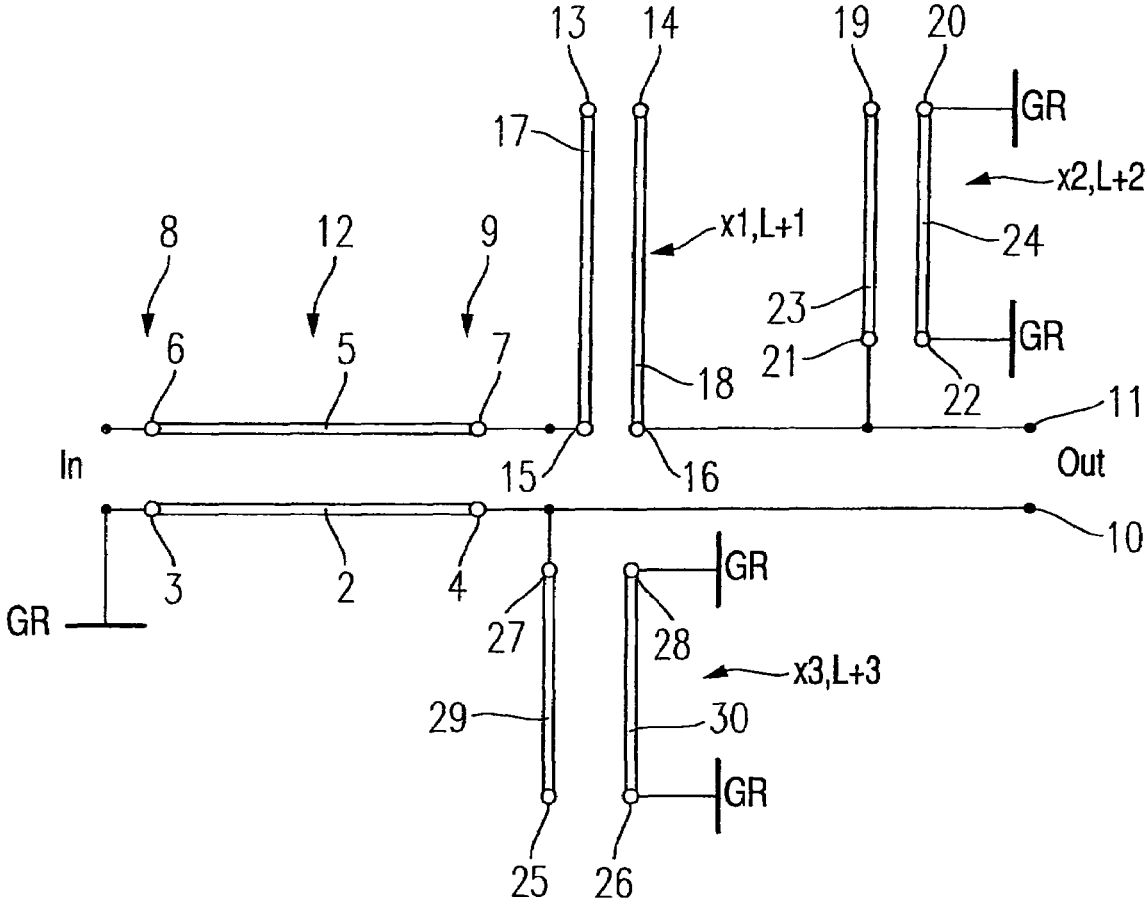
FIG. 7 shows a sixth exemplary embodiment of a re-balancing arrangement according to the invention.

FIG. 7 shows a sixth exemplary embodiment of a re-balancing arrangement 1 according to the invention similar to the fifth exemplary embodiment illustrated in FIG. 6. By way of difference from the fifth exemplary embodiment of FIG. 6, in each case, the first poles 13, 14 of the first line portion Lt1, the first poles 19, 20 of the second line portion Lt2, and the first poles 25, 26 of the third line portion Lt3 are open, and not short-circuited as in the fifth exemplary embodiment.

The invention claimed is:

1. A Re-balancing arrangement comprising:

a line, including, a first pole of a first conductor; and a first pole of a second conductor on a first side; and a second pole of said first conductor and a second pole of said second conductor on a second side;

wherein said second side of said line is connected to a network comprising impedances and a symmetrical connection with a first end and a second end;

wherein said first pole of said first conductor runs directly to a reference potential;

wherein said two first poles form an asymmetrical connection; and wherein said second pole of said first conductor is connected directly to said first end of said symmetrical connection and via a third impedance to said reference potential, and said second pole of said second conductor is connected to said second end of said symmetrical connection via a first impedance and to said reference potential via said series connection of said first impedance and a second impedance, and that all of said impedances are electromagnetically decoupled from each other; or said second pole of said second conductor is connected directly to said second end of said symmetrical connection and via a third impedance to said reference potential, and that said second pole of said first conductor is connected to said second end of said symmetrical connection via a first impedance and to said reference potential via said series connection of said first impedance and a second impedance, and that all of said impedances are electromagnetically decoupled from each other.

2. The Re-balancing arrangement of claim 1, wherein said network partially takes over said phase displacement required for re-balancing.

3. The Re-balancing arrangement 1 wherein said impedances are formed by inductances.

4. The Re-balancing arrangement of claim 1, wherein said impedances are formed by capacitances.

5. The Re-balancing arrangement of claim 1 wherein said impedances are formed by line portions open or short circuited at one end.

6. The Re-balancing arrangement of claim 5, wherein said line portions are formed from at least one of: two-wire lines, striplines, microstriplines, or coaxial cable.

7. The Re-balancing of claim 6 wherein the electrical structure of said line portions is largely homogeneous.

8. The Re-balancing of claim 5 wherein the electrical structure of said line portions is largely homogeneous.

9. The Re-balancing arrangement of claim 1 wherein said line is formed from at least one of: two-wire line, stripline, microstripline, or coaxial cable.

10. The Re-balancing arrangement of claim 9 wherein the electrical structure of said line is substantially homogeneous.

11. The Re-balancing arrangement of claim 1 wherein said second impedance and said third impedance provide the same impedances.

12. The Re-balancing arrangement of claim 1 wherein the electrical length of at least one of said homogeneous line or of said first and second conductors is shorter than one quarter of the wavelength of a frequency to be transmitted.

13. The Re-balancing arrangement of claim 1 wherein the electrical length of at least one of said homogeneous line or of said first and second conductors corresponds to a mean wavelength of a frequency band to be transmitted.

14. The Re-balancing arrangement of claim 1 wherein at least a portion of said re-balancing arrangement is formed using stripline technology.

* * * * *